US005327201A

United States Patent [19]

Coleman et al.

[11] Patent Number: 5,327,201

[45] Date of Patent: Jul. 5, 1994

[54] SIMULATED PHOTOGRAPHIC PRINTS USING A REFLECTIVE COATING

[75] Inventors: Robert M. Coleman, Altadena; Leland D. Green, Sierra Madre, both of Calif.

[73] Assignee: Xerox Corporation, Stamford, Conn.

[21] Appl. No.: 95,622

[22] Filed: Jul. 21, 1993

[51] Int. Cl.[5] ..... G03G 8/00; G03G 15/14

[52] U.S. Cl. ..... 355/278; 156/277; 355/202

[58] Field of Search ..... 355/200, 202, 271, 277, 355/278, 279, 282, 285, 290, 326, 327; 156/277, 290, 292; 430/44, 104, 99

[56] References Cited

U.S. PATENT DOCUMENTS

| | | | |
|---|---|---|---|
| 3,914,097 | 10/1975 | Wurl | 432/59 |
| 4,066,802 | 1/1978 | Clemens | 427/24 |
| 4,504,837 | 3/1985 | Toyoda et al. | 156/277 X |
| 4,600,669 | 7/1986 | Ng et al. | 430/47 |
| 4,686,163 | 8/1987 | Ng et al. | 430/47 |
| 4,721,635 | 1/1988 | Helinski | 156/277 X |
| 4,724,026 | 2/1988 | Nelson | 156/233 |
| 4,868,049 | 9/1989 | Nelson | 428/328 |
| 4,891,677 | 1/1990 | Shiozawa et al. | 355/278 X |
| 4,949,103 | 8/1990 | Schmidlin et al. | 346/150 |
| 5,065,183 | 11/1991 | Morofuji et al. | 355/202 |
| 5,108,865 | 4/1992 | Zwaldo et al. | 430/126 |
| 5,126,797 | 6/1992 | Forest et al. | 355/278 |

FOREIGN PATENT DOCUMENTS

| | | | |
|---|---|---|---|
| 2621625 | 11/1977 | Fed. Rep. of Germany | 355/202 |
| 63-6586 | 1/1988 | Japan | 355/278 |
| 63-71875 | 12/1988 | Japan | 355/202 |
| 63-302042 | 12/1988 | Japan | 156/277 |

*Primary Examiner*—A. T. Grimley
*Assistant Examiner*—William J. Royer

[57] ABSTRACT

Simulated photographic prints are created using xerographic imaging. A transparent carrier having a xerographically formed mirror image fused thereto is bonded to a plastic substrate through the use of heat and pressure. The transparent carrier and the plastic substrate form the finished print.

18 Claims, 5 Drawing Sheets

SIMULATED PHOTOGRAPHIC PRINTS USING A REFLECTIVE COATING

BACKGROUND OF THE INVENTION

This invention relates generally to color imaging and more particularly to a method of producing simulated photographic prints using xerography.

In the practice of conventional xerography, it is the general procedure to form electrostatic latent images on a xerographic surface by first uniformly charging a charge retentive surface such as a photoreceptor. The charged area is selectively dissipated in accordance with a pattern pf activating radiation corresponding to original images. The selective dissipation of the charge leaves a latent charge pattern on the imaging surface corresponding to the areas not exposed by radiation.

This charge pattern is made visible by developing it with toner by passing the photoreceptor past a single developer housing. The toner is generally a colored toner which adheres to the charge pattern by electrostatic attraction. The developed image is then fixed to the imaging surface or is transferred to a receiving substrate such as plain paper to which it is fixed by suitable fusing techniques.

Recently, there has been a great deal of effort directed to the development of color copiers/printers which utilize the xerographic process. Such efforts have resulted in the recent introduction of the Xerox 5775 copier/printer and the Fuji Xerox A-Color 635 copier/printer.

The quality of color xerographic images on paper has approached the quality of color photographic prints. However, color xerographic prints fall short because they do not have the uniform gloss, the wide density range or the brilliance typical of photographic prints. Nor do xerographic prints have the feel of photographic prints because the paper usually used it too lightweight and too limp.

Typically the surface of color toner images is irregular or rough or rather lumpy. The behavior of incident white light vis-a-vis such color images is believed to be as follows:

Some of the white light incident on the substrate carrying the color toner images specularly reflects off the substrate;

Some of the light goes down into the paper, scatters around and comes back out in various directions, some through the toner and some not;

Because the toner surface is rough or irregular some of the light incident thereon is reflected off the toner in various directions.

Some of the light incident on the irregular toner surfaces passes through the toner into the paper and comes back out in various directions White light becomes colored due to selective absorption at it passes through toner. The light then goes down into the paper and back out through the toner where it becomes more colored. As will be appreciated, any white light which does not pass through the toner diminishes the appearance of the final print.

Attempts to make up this deficiency in conventionally formed color toner images have led to the lamination of xerographic images on paper using a transparent substrate. This procedure has been only partially successful because the lamination process tends to reduce the density range of the print resulting in a print that has less shadow detail. The lamination process also adds significant weight and thickness to the print.

Additionally, it is believed that the reason that the aforementioned lamination process does not produce good results resides in the fact that typically the color toner images at the interface between the laminate and the toner do not make suitable optical contact. That is, the toner image at the interface is still irregular (i.e. creating voids) enough after lamination that light is reflected from at least some of those surfaces and is precluded from passing through the toner. In other words, when there are voids between the transparency and toner image, light gets scattered and reflected back without passing through the colored toner. Loss of image contrast results when any white light is scattered, either from the bottom surface of the transparent substrate or from the irregular toner surfaces and doesn't pass through the toner.

A known method of improving the gloss of color xerographic images on a transparent substrate comprises refusing the color images. Such a process was observed at a NOMDA trade show in 1985 at a Panasonic exhibit. The process exhibited was carried out using an off-line transparency fuser, available from Panasonic as model FA-F100, in connection with a color xerographic copier which was utilized for creating multi-color toner images on a transparent substrate for the purpose of producing colored slides. Since the finished image from the color copier was not really suitable for projection, it was refused using the aforementioned off-line refuser. To implement the process, the transparency is placed in a holder intermediate which consists of a clear relatively thin sheet of plastic and a more sturdy support. The holder is used for transporting the imaged transparency through the off-line refuser. The thin clear sheet is laid on top of the toner layer on the transparency. After passing out of the refuser, the transparency is removed from the holder. This process resulted in an attractive high gloss image useful in image projectors. The refuser was also used during the exhibit for refusing color images on paper. However, the gloss is image-dependent. Thus, the gloss is high in areas of high toner density because the toner refuses in contact with the clear plastic sheet and becomes very smooth. In areas where there is little or no toner the gloss is only that of the substrate.

The following is a discussion of prior art which may be relevant to the patentability of the present invention:

U.S. Pat. Nos. 4,686,163 and 4,600,669 describe an electrophotographic imaging method that uses an element comprising a photoconductive layer on an electrically conducting substrate capable of transmitting actinic radiation to which the photoconductive layer is responsive, and a dielectric support, releasably adhered to the substrate, comprising the photoconductive layer or an overcoat thereof forming a surface of the element capable of holding an applied electrostatic charge. To use the element, the surface of the dielectric support is charged, and the photoconductive layer is imagewise-exposed to actinic radiation, thereby forming a developable electrostatic image on the dielectric surface. The electrostatic image, in turn, is developed with toner to form a first color image. A composite color image is formed on the element by repeating the sequence one or more times with imagewise exposure of the photoconductive layer to actinic radiation transmitted through the substrate, and developing over each preceding image with a different color toner. The composite toner image is transferred with the dielectric support to a receiving element to form a color copy such as a three-color filter array or a color proof closely simulating the color print expected from a full press run.

The dielectric support on the photoconductive layer comprised a transparent blend of poly (vinylacetate-co-crotonic acid, 95/5 mole ratio) and cellulose acetate butyrate. The resulting multicolor proof presented a multicolor toner image against a white paper background and protected by the overlying dielectric support, thus accurately resembling a multicolor print from a full press run.

The receiver element to which the dielectric support and composite toner image are transferred can be any suitable material against or through which the toner image is desired to be viewed. The receiver can be print stock, such as paper, upon which a press run will be conducted. The receiver can also be of transparent material such as a polymeric film. With respect to the latter, the invention also contemplates, as an embodiment, transfer of the composite toner image and dielectric support to image-bearing elements such as microfilm or microfiche so that the composite color image forms information in addition to image information already present on such image-bearing elements. In addition, the invention contemplates the use of transparent glass or nonbirefringent translucent polymeric materials such as cellulose esters for use as the receiver. Receivers manufactured from such materials are suited for use in forming three-color filter arrays by the process described herein involving the formation of filter array matrices of the complementary colorants cyan, magenta and yellow in the respective color toner imaging steps. If desirable, the receiver can also contain a suitable overcoat layer adapted to soften under the influence of pressure and heat during the transfer step. In this manner, the adhesion of the dielectric support and composite toner image to the receiver can be enhanced.

The electrophotographic element bearing the multicolor toner image is moved to a separate lamination device comprising heated metal and rubber rolls, together forming a nip. The toner image is passed through the nip with and against a white receiver paper at a roll temperature of 100° C. (212° F) and a pressure of 225 pounds per square inch (1.551 MPa) to effect transfer of the dielectric support and composite image to the receiver followed by peeling off the rest of the electrophotographic element.

U.S. Pat. No. 4,066,802 granted on Jan. 3, 1978 to Carl F. Clemens discloses a method of decalcomania in which a toner image pattern is formed on a transfer member which has been overcoated with an abhesive material. A polymeric sheet is interposed between the toner image and a cloth or other image receiving medium. The polymeric sheet assists in the permanent adherence of the toner imaging pattern to the cloth material or other medium when the composite is subjected to heat and pressure. The transfer member and method of its use are set forth. Another embodiment discloses the use of solvent to fix the image to a cloth material.

U.S. Pat. No. 5,065,183 granted on Nov. 12, 1991 to Morofuji et al discloses a multicolor printing method for printing multicolor picture images upon a material or object to be printed comprises the steps of, in accordance with a first embodiment of the invention, the formation of a multicolor toner image upon a flexible belt by means of electrophotographic printing methods or techniques, and the transfer of such multicolor toner image directly to the material or object to be printed, such as, for example, a container made of, for example, metal, paper, plastic, glass, or the like, by means of a thermo-transferring process. In accordance with a second embodiment of the invention, the multicolor toner image is formed upon a plastic film, which is laminated upon the flexible belt, by means of electrophotographic printing methods or techniques, and the plastic film is then transferred to and fused upon the container. In accordance with a third embodiment of the invention, a photoconductive member is irradiated by means of exposure light upon a rear surface thereof wherein the multicolor picture images are also formed by electrophotographic printing methods or techniques. In this manner, previously formed toner images upon the photoconductive member do not interfere with the image exposure processing.

U.S. Pat. No. 5,126,797 granted on Jun. 30, 1992 to Forest et al discloses a method and apparatus for laminating toner images wherein a toner image on a receiving sheet is laminated using a transparent laminating sheet fed from the normal copy sheet supply of a copier, printer or the like. The laminating sheet is fed into laminating contact with the toner image after the toner image has been formed on a receiving sheet. The resulting sandwich is fed through the fuser laminating the image between the sheets. The invention is particularly usable in forming color transparencies.

U.S. Pat. No. 5,108,865 granted to Zwaldo et al on Apr. 28, 1992 discloses a method including the steps of:

contacting an image (preferably multi-toned image) with a transfer web (intermediate receptor layer) comprising in sequence, a carrier layer, a transferable release layer, and a releasable adhesive layer (releasable from the carrier layer along with the transferable release layer so that both layers transfer at once), said adhesive layer being in contact with said toned image, said contacting being done under sufficient heat and/or pressure to enable said toned image to be adhered to said releasable adhesive layer with greater strength than the adherence of said toned image to said imaging surface of said photoconductive layer;

separating the transfer web and said photoconductive layer so that the toned image is removed from said photoconductive layer and remains adhered to the adhesive layer of the transfer web; contacting the surface of the transfer web having both the multi-toned image and adhesive thereon with a permanent receptor surface;

adhering the adhesive on the transfer web to the permanent surface; and removing the carrier layer of the transfer web from the adhesive and the release layer of the transfer web so that an image article is formed of the permanent receptor, multi-toned image, releasable adhesive, and the resultant surface coating of the release layer which is furthest away from the permanent receptor.

U.S. Pat. No. 4,949,103 granted to Schmidlin et al on Aug. 14, 1990 discloses a direct electrostatic printing (DEP) device utilized for printing mirror or reverse/-wrong reading toner images on a transparent substrate. An adhesive coating on the transparent substrate on the toner image side thereof enables the transparent substrate to be affixed to substrate such as an envelope such that the mirror images are right reading.

U.S. Pat. Nos. 4,868,049 and 4,724,026 granted to Marshall A. Nelson on Sep. 19, 1989 and Feb. 9, 1988, respectively disclose selective metallic transfer foils for selectively transferring metallic foil to xerographic images on a receiving substrate such a paper. The transfer sheet comprises, in successive layers, a carrier film, a metallic film and an adhesive, the adhesive containing a dispersion of 0.5 micron or larger particulate material. A method is disclosed for forming images overlaid with metallic foil. According to the method of the invention, a sheet comprising xerographic images is provided and placed in face-to-face contact with a metal transfer sheet, to form a sandwich with the xerographic images on the inside. Heat and pressure are applied to the sandwich, causing the xerographic images to become tacky and causing the metallic foil to selectively adhere to the images. The remainder of the transfer sheet is then stripped away from the resulting decorated sheet comprising xerographic images overlaid with metallic foil.

In the preferred embodiment of the invention, the metal transfer sheet is provided with an adhesive of high filler content resin which has been found to produce good quality transfers to xerographic images produced by a wide variety of toners and photocopy machinery.

U.S. Pat. No. 3,914,097 granted to Donald R. Wurl on Oct. 21, 1975 discloses a sheet guide and cooling apparatus for preventing curl in sheets bearing a developed image, the image being permanently fixed to the sheet by application of heat and pressure. The apparatus is positioned to have a flat thermally conductive surface establishing a path for the sheet, downstream of the fixing area, the path extending in a plane substantially coplanar with the plane of sheet travel in the fixing station. Vacuum means associated with the surface maintains successive incremental portions of a sheet in face-to-face contact with the flat surface as it is being guided for at least a predetermined period as the sheet moves along the path and furthermore, provides a flow of cooling air for the surface.

U.S. patent application, Ser. No. 08/095,639 filed on the same date as the instant application discloses a method and apparatus for creating simulated photographic prints wherein a mirror image is formed on a transparent substrate. The transparent substrate has bonded thereto a backing sheet which serves as protection for the powder images on the transparent substrate as well as a reflective backing which significantly enhances the look of the images. The transparent substrate and backing sheet are bonded together by simultaneously passing the two members between a pair of heated rollers while simultaneously applying pressure.

U.S. patent application Ser. No. 08/095,016 filed on the same date as the instant application discloses a device for creating simulated photographic prints. As disclosed therein, a transparent substrate with a reverse reading toner image thereon is bonded to a backing sheet using heat and pressure provided by a pair of heat and pressure roller members. A second pair of rollers are provided downstream of the heat and pressure roll pair and receives the leading edge of a simulated photographic print and serves to pull the print in order to flatten it. A vacuum holddown transport downstream of the puller rolls serves to further flatten the print during a cool-down period.

U.S. patent application Ser. No. 08/095,790 filed on the same date as the instant application discloses a device for creating simulated photographic prints using the xerographic process. As disclosed therein, light reflecting sheet is bonded to a transparent substrate containing a xerographically formed toner image. The sheet and transparent substrate are held in a flat condition while applying heat and pressure for effecting the aforementioned bonding. The sheet and substrate are supported on a piece of tempered glass during the bonding process.

According to the invention disclosed in U.S. patent application Ser. No. 08/095,639, incident light impinging on the image side of a simulated photographic print must pass through a transparent substrate and the toner images contained on the substrate prior to being reflected back by a light colored backing sheet. Additionally, the incident light must also pass through a layer of clear adhesive utilized to bond the transparent substrate to the backing sheet. As will be appreciated, the more layers that the incident light has to pass through before it is reflected, the more likely that image contrast and brilliance will be affected.

U.S. patent application, Ser. No. 08/095,136 filed on the same date as the instant application discloses a device for creating simulated photographic prints wherein a transparent carrier having a xerographically formed mirror image fused thereto is bonded to a pair of plastic substrate through the use of heat and pressure. The transparent carrier and the plastic substrate form the finished print which exhibits an improved degree of flatness over other such prints.

U.S. patent application, Ser. No. 08/095,788 filed on the same date as the instant application discloses a kit for creating simulated photographic prints using xerographic imaging. The kit comprises a transparent carrier suitable for having a reverse reading toner image fused thereto and a reflective backing sheet, the latter of which is coated with a heat activatable adhesive material for bonding the latter to the former. The kit further includes a rigid surface of tempered glass upon which the transparent substrate is supported during bonding. An adhesive member is provided for covering the transparent carrier during the process of making prints.

BRIEF SUMMARY OF THE INVENTION

The primary object of the present invention is to create simulated color photographic prints using xerography wherein the print has the look and feel of a conventional color photograph. Additionally, it is an object of the present invention to improve the contrast of simulated photographic prints created using the xerographic process.

Briefly, the present invention is carried out by first creating a multi-color, reverse reading (or mirror) toner image on a transparent substrate. The multi-color toner image is xerographically created by sequentially forming different color toner images on the transparent substrate followed by the use of heat and pressure or other suitable means to affix or fuse the multi-color image to the transparent substrate such that there is good optical contact at the interface between the transparent substrate and the toner. The toner carrying side of the transparent substrate is bonded to a backing sheet after being coated with a light reflective coating to form a simulated print which has the look and feel of an actual photographic print. The transparent substrate may be coated with a suitable resin for the purpose of enhancing the adherence of a glue deposited on the backing sheet.

Satisfactory results have been obtained by applying a light reflective coating such as a white or near white glue or toner over the toner image on the transparent substrate. The transparent substrate is then adhered to the backing sheet by passing a sandwich formed thereby through a heat and pressure roll fuser. A plain sheet of paper may be placed in contact with the nonimaged side of the transparent substrate during passage of the transparent substrate and backing sheet through the roll pair to prevent degradation of the top surface of the print.

In the foregoing manner, the transparent substrate with the toner image is adhered to a backing sheet to form a simulated photographic print. The resulting print exhibits an attractive and brilliant appearance which is more fade resistance and durable than commercially available photographic prints. Prints created in the foregoing manner have the look and feel of photographic prints but appear to have more brilliance. This is through to be attributable to the xerographically formed prints having a lesser minimum density than conventional photographic prints resulting in whiter whites.

A further aspect of this invention is that exceptionally good quality prints can be more quickly and more cost effectively produced than with conventional photographic printing techniques, especially in the case of larger size prints. Additionally, this process does not require silver, photographic chemicals, or intermediary negatives even when a black and white print is created from a color original.

Existing color xerographic copier/printer systems can be used for the process. Thus, all the resources associated with these products, particularly the ones which utilize state of the art electronic devices such as film scanners, image composition enhancers, color adjusters and editors can be utilized.

DETAILED DESCRIPTION OF THE PREFERRED EMBODIMENT OF THE INVENTION

Figure 1:
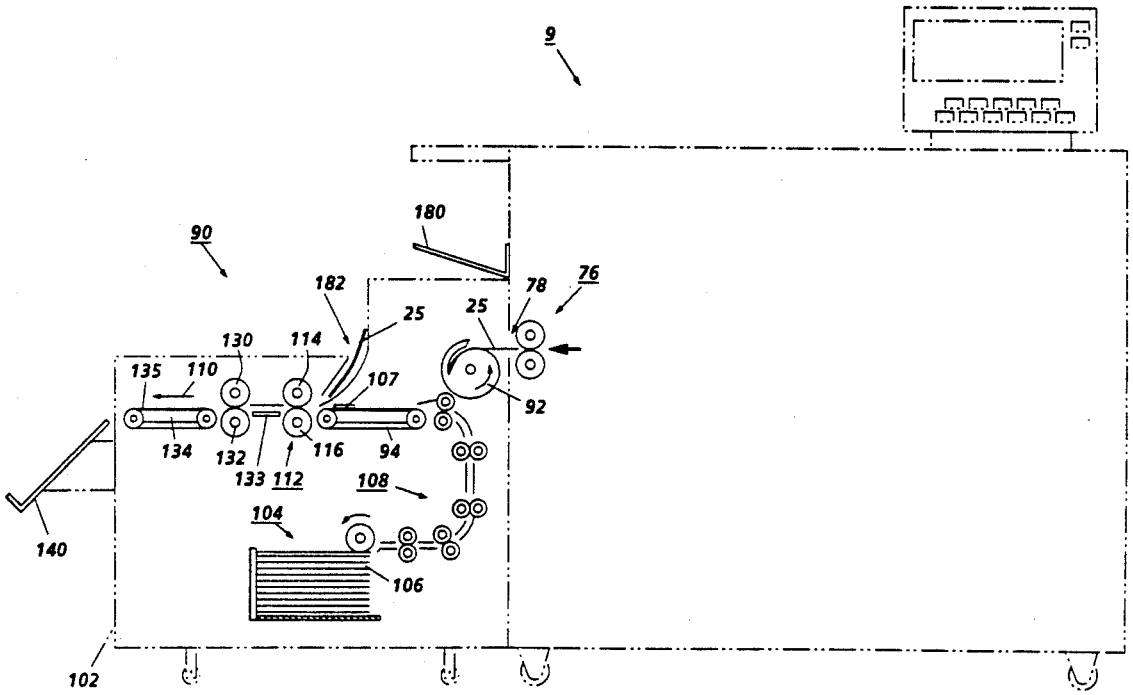
FIG. 1 is a side elevational view of an imaging apparatus and a print processor.

While the present invention will hereinafter be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like references have been used throughout to designate identical elements.

Figure 5:
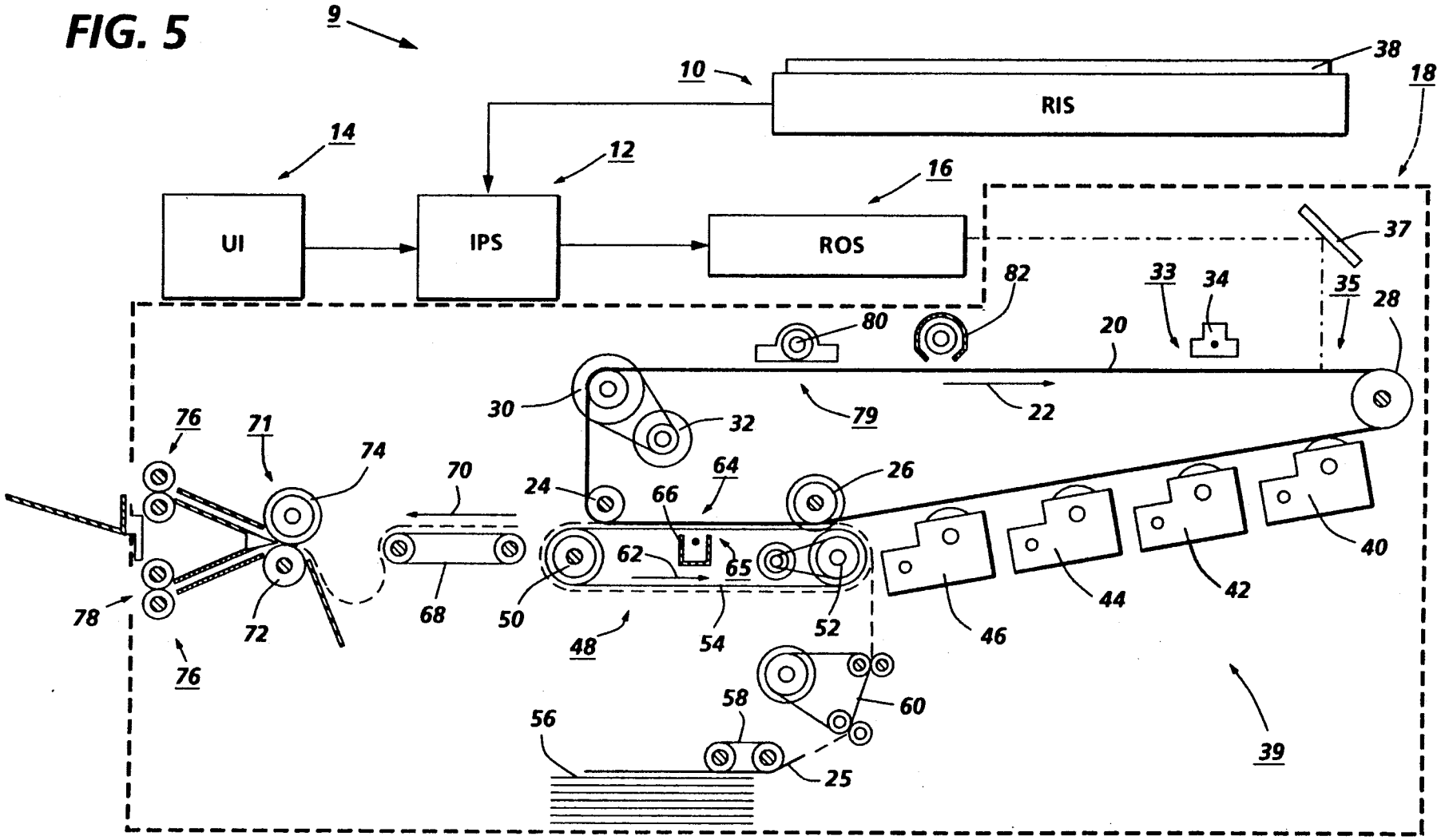
FIG. 5 is a schematic illustration of an imaging apparatus suitable for use of the present invention.

FIG. 5 is a schematic elevational view of an illustrative electrophotographic copier which may be utilized in carrying out the present invention. It will become evident from the following discussion that the present invention is equally well suited for use in a wide variety of printing systems, and is not necessarily limited in its application to the particular system shown herein.

Turning initially to FIG. 5, during operation of a printing system 9, a multi-color original document or photograph 38 is positioned on a raster input scanner (RIS), indicated generally by the reference numeral 10. The RIS contains document illumination lamps, optics, a mechanical scanning drive, and a charge coupled device (CCD array). The RIS captures the entire original document and converts it to a series of raster scan lines and measures a set of primary color densities, i.e. red, green and blue densities, at each point of the original document. This information is transmitted to an image processing system (IPS), indicated generally by the reference numeral 12. IPS 12 contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The output signal from UI 14 is transmitted to IPS 12. Signals corresponding to the desired image are transmitted from IPS 12 to a ROS 16, which creates the output image. ROS 16 lays out the image in a series of horizontal scan lines with each line having a specified number of pixels per inch. ROS 16 includes a laser having a rotating polygon mirror block associated therewith. ROS 16 is utilized for exposing a uniformly charged photoconductive belt 20 of a marking engine, indicated generally by the reference numeral 18, to achieve a set of subtractive primary latent images. The latent images are developed with cyan, magenta, and yellow developer material, respectively. These developed images are transferred to a final substrate in superimposed registration with one another to form a multi-color image on the substrate. This multi-color image is then heat and pressure fused to the substrate thereby forming a multi-color toner image thereon.

The printing system 9 is capable of printing conventional right reading toner images on plain paper or mirror images on various other kinds of substrates as will be discussed hereinafter. Mirror or reverse reading images on final substrates are effected through programmed use of the UI 14.

The features of the printing system hereinabove described are utilized in the commercially available 5775 copier.

With continued reference to FIG. 5, printer or marking engine 18 is an electrophotographic copier machine. Photoconductive belt 20 of marking engine 18 is preferably made from a polychromatic photoconductive material. The photoconductive belt moves in the direction of arrow 22 to advance successive portions of the photoconductive surface sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform electrostatic potential.

Next, the charged photoconductive surface is moved through an exposure station, indicated generally by the reference numeral 35. Exposure station 35 receives a modulated light beam corresponding to information derived by RIS 10 having a multi-color original document 38 positioned thereat. RIS 10 captures the entire image from the original document 38 and converts it to a series of raster scan lines which are transmitted as electrical signals to IPS 12. The electrical signals from RIS 10 correspond to the red, green and blue densities at each point in the original document. IPS 12 converts the set of red, green and blue density signals, i.e. the set of signals corresponding to the primary color densities of original document 38, to a set of colorimetric coordinates. The operator actuates the appropriate keys of UI 14 to adjust the parameters of the copy. UI 14 may be a touch screen, or any other suitable control panel, providing an operator interface with the system. The output signals from UI 14 are transmitted to IPS 12. The IPS then transmits signals corresponding to the desired image to ROS 16. ROS 16 includes a laser with rotating polygon mirror block. Preferably, a nine facet polygon is used. ROS 16 illuminates, via mirror 37, the charged portion of photoconductive belt 20 at a rate of about 400 pixels per inch. The ROS will expose the photoconductive belt to record three latent images. One latent image is developed with cyan developer material. Another latent image is developed with magenta developer material and the third latent image is developed with yellow developer material. The latent images formed by ROS 16 on the photoconductive belt correspond to the signals transmitted from IPS 12.

After the electrostatic latent images have been recorded on photoconductive belt 20, the belt advances such latent images to a development station, indicated generally by the reference numeral 39. The development station includes four individual developer units indicated by reference numerals 40, 42, 44 and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to a compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document or in combination with any or all of the color developer units. Each of the developer units is moved into and out of an operative position. In the operative position, the magnetic brush is closely adjacent to the photoconductive belt, while in the non-operative position, the magnetic brush is spaced therefrom. In FIG. 5, developer unit 40 is shown in the operative position with developer units 42, 44 and 46 being in the non-operative position. During development of each electrostatic latent image, only one developer unit is in the operative position, the remaining developer units are in the non-operative position. This ensures that each electrostatic latent image is developed with toner particles of the appropriate color without commingling.

It will be appreciated by those skilled in the art that scavengeless or non-interactive development systems well known in the art could be used in lieu of magnetic brush developer structures. The use of non-interactive developer systems for all but the first developer housing would make it unnecessary for movement of the developer housings relative to the photoconductive imaging surface.

After development, the toner image is moved to a transfer station, indicated generally by the reference numeral 65. Transfer station 65 includes a transfer zone, generally indicated by reference numeral 64. In transfer zone 64, the toner image is transferred to a transparent substrate 25. At transfer station 65, a substrate transport apparatus, indicated generally by the reference numeral 48, moves the substrate 25 into contact with photoconductive belt 20. Substrate transport 48 has a pair of spaced belts 54 entrained about a pair of substantially cylindrical rollers 50 and 52. A substrate gripper (not shown) extends between belts 54 and moves in unison therewith. The substrate 25 is advanced from a stack of substrates 56 disposed on a tray. A friction retard feeder 58 advances the uppermost substrate from stack 56 onto a pre-transfer transport 60. Transport 60 advances substrate 25 to substrate transport 48. Substrate 25 is advanced by transport 60 in synchronism with the movement of substrate gripper, not shown. In this way, the leading edge of substrate 25 arrives at a preselected position, i.e. a loading zone, to be received by the open substrate gripper. The substrate gripper then closes securing substrate 25 thereto for movement therewith in a recirculating path. The leading edge of substrate 25 is secured releasably by the substrate gripper. As belts 54 move in the direction of arrow 62, the substrate moves into contact with the photoconductive belt, in synchronism with the toner image developed thereon. At transfer zone 64, a corona generating device 66 sprays ions onto the backside of the substrate so as to charge the substrate to the proper electrostatic voltage magnitude and polarity for attracting the toner image from photoconductive belt 20 thereto. The substrate remains secured to the substrate gripper so as to move in a recirculating path for three cycles. In this way, three different color toner images are transferred to the substrate in superimposed registration with one another to form a composite multi-color image 67. According to the invention, the composite toner image formed on the photoconductive belt 20 is a right reading image so that after transfer thereof, to a transparent substrate in a manner to be described hereinafter, the image represents a wrong or reverse reading multi-color toner image when viewed from the toner side and is right reading when viewed through the substrate.

The transparent substrate 25 preferably comprises transparent polyester material such as Mylar, commercially available from E. I. DuPont. A suitable thickness for the transparent substrate for use in forming simulated photographic prints using the xerographic process described above is approximately 0.0042 inch. The actual thickness of the transparent substrate will depend on the xerographic processor which is used for making the color images on the transparent substrate. An important characteristic of the substrate 25 is that its glass transition temperature is substantially above that of the toner materials employed in creating the images thereon.

One skilled in the art will appreciate that the substrate may move in a recirculating path for four cycles when under color removal and black generation is used and up to eight cycles when the information on two original documents is being merged onto a single substrate. Each of the electrostatic latent images recorded on the photoconductive surface is developed with the appropriately colored toner and transferred, in superimposed registration with one another, to the substrate to form a multi-color facsimile of the colored original document. As may be appreciated, the imaging process is not limited to the creation of color images. Thus, high quality black and white simulated photographic prints may also be created using the process disclosed herein.

After the last transfer operation, the substrate gripper opens and releases the substrate. A conveyor 68 transports the substrate, in the direction of arrow 70, to a heat and pressure fusing station, indicated generally by the reference numeral 71, where the transferred toner image is permanently fused to the substrate. The fusing station includes a heated fuser roll 74 and a pressure roll 72. The substrate passes through the nip defined by fuser roll 74 and pressure roll 72. The toner image contacts fuser roll 74 and is affixed to the transparent substrate. The fusing process effects an excellent optical interface between the fused toner and the transparent substrate. Thereafter, the substrate is advanced by a pair of rolls 76 to an outlet opening 78 through which substrate 25 is conveyed to a processor to be discussed hereinafter.

The last processing station in the direction of movement of belt 20, as indicated by arrow 22, is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

The transparency 25 having the composite, reverse reading color image 67 thereon is utilized in an off-line processor 90 for creating a simulated color photographic print. In one mode of operation, the transparencies 25 are fed from the printing system 9 through the outlet opening 78 and inverted using an inverter 92 and deposited on a transport 94 forming a part of the processor 90.

The processor 90 comprises a housing 102 adapted to be supported closely adjacent in an abutting relationship with the printing system 9. Suitable electrical hardware, not shown, is provided for electrically connecting the auxiliary processor 90 to the controls of the printer 9. Supported within the housing 102 is a supply 104 of white plastic sheets 106. A sheet feeder 108 may comprise any suitable configuration for transporting the sheets, one at a time, into registry with a transparent substrate 25 received from the printing system 9. To this end, a registration member 107 is provided. In operation, a sheet 106 is fed to the registration member where it is held until a transparent substrate 25 is positioned in superimposed registration with the sheet 106.

Figure 3:
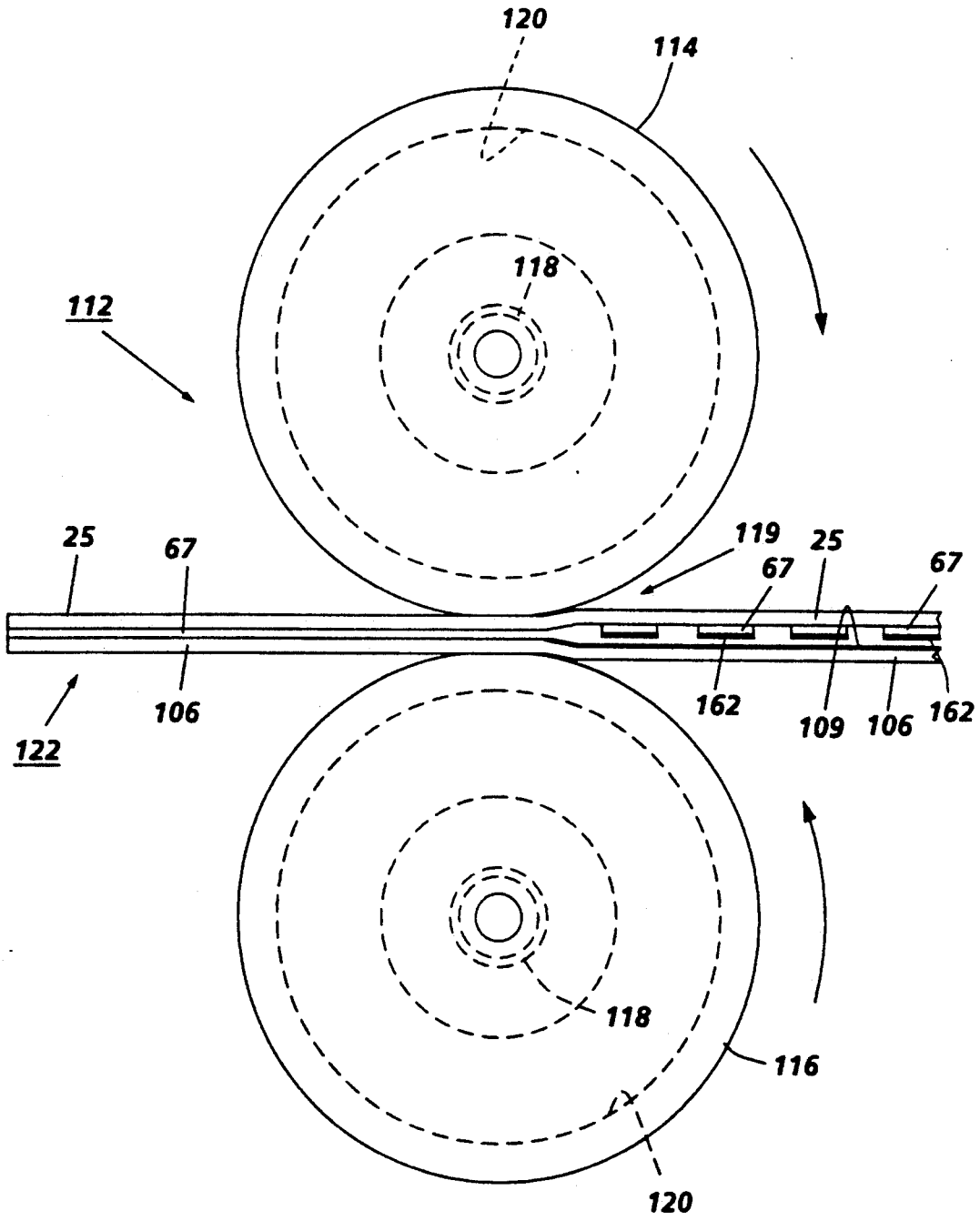
FIG. 3 is a side plan view of a heat and pressure roll arrangement and the members used for creating simulated photographic prints using xerography.

Optimally, the sheets 106 which have been precoated with a white adhesive such as white toner or glue 109 (FIG. 3) are fed in the direction of the arrow 110 to a heat and pressure fuser generally indicated by reference character 112. Under certain conditions, the glue may be omitted. For example, when a full coverage composite image is formed on the transparent substrate satisfactory bonding of the backing sheet 106 to the transparent substrate 25 can be effected without the use of an adhesive on the backing sheet 106. In this instance the toner materials forming the toner image serve to adhere the members, one to the other.

A number of adhesives can be selected for use in the present invention including materials that will enable the layers to substantially permanently bond to each other and not easily separate after extended time periods, such as for up to 1 year. An example of a suitable adhesive is available from the 3M company and is designated as556 Bonding Film to which a suitable brightener or whitener such as titanium dioxide has been added in order to produce a white or near white color and, therefore, a light reflective adhesive. This bonding film comprises 40 to 50% by weight of polyterpene resin, 30 to 40% by weight of ethylent-vinyl acetate polymer, 10 to 20% by weight of polyethylene and 1 to 10% by weight of thermoplastic polymer. A layer of this bonding film may be applied directly to the sheets 106 or it may be transferred thereto using a carrier sheet containing the bonding film as provided by the manufacturer. In the case of the latter method, the sheet 106 and the film carrier are simultaneously heated while contacting each other for effecting transfer of the bonding film to the backing sheet 106.

The heat and pressure fuser 112 (FIG. 1) comprises heated roll members 114 and 116 (approximately 2 inches in diameter) each having a heating element 118 supported internally thereof. The heating elements are controlled at their operating temperatures (i.e. roll surface temperatures) via controls forming a part of the IPS 12. A satisfactory roll surface temperature for each of the rolls is approximately 160° C. The rolls are pressured engaged in any conventional manner to exert an average pressure of 175 psi thereby forming a nip 119 between the two rolls. Each of the rolls has an exterior coating 120 of silicone rubber. The thickness of the coating on the roll member 114 is approximately 0.05 inch while the thickness of the coating on the roll member 116 is approximately 0.31 inch. The heat and pressure fuser 112 serves to form a color print 122 comprising the transparent substrate 25, a composite color image 67 fused to the transparent substrate and a reflective backing layer adhered to the composite toner image. In operation, the rolls 114 and 116 move the substrates at a process speed of approximately 3.4 inches per seconds. As will be appreciated, various combinations of heat and pressure members may be employed. For example, different rubber thicknesses could be utilized and only one roll might be internally heated. Externally heated rolls are also contemplated.

A pair of auxiliary rolls 130 and 132 (FIGS. 1 and 2) positioned downstream of the fuser 112 serve to pull the bonded members in the form of the print 122 in a straight path away form the heated fuser rolls. The rolls 130 and 132 are operated at the same or slightly faster surface velocity as that of the rolls 114 and 116 for effecting the pulling action noted. A heated platen 133 is provided intermediate the rolls 130, 132 and the rolls 114, 116 for supporting the simulated print 122 (FIG. 3) in a flat orientation while being pulled by the rolls 130 and 132.

A flat vacuum transport comprising a plenum 134 and a plurality of belts 135 serves to move the print in a flat orientation away from the rollers 130 and 132 to effect cooling of the simulated print while it is restrained in a flat orientation by the vacuum transport. The finished print is received in a catch tray 140 for removal or temporary storage thereof.

The white or near white backing sheet or substrate 106 may comprise a white or near white sheet of plastic paper as described in U.S. Pat. No. 5,075,153. As disclosed therein, the coated paper comprises a plastic supporting substrate such as polyester rather than natural cellulose, with certain coatings thereover. Mylar, commercially available from E. I. DuPont is preferred as the substrate for the coated sheet 106 in view of its availability and lower cost. The coated sheet 106 has a thickness of about 0.004 inch. The appearance of the image can be altered by using substrates that have different shades of white. For example, a creamy substrate could be used for portraits, and a bright white substrate could be used for product shots. The gloss could also be modified by changing the surface characteristics of the transparency material either with the use of matte or silk finish surfaces on the transparency.

The simulated print 122 comprising the transparent substrate 25, reflective backing sheet 106 and the composite toner layer 67 have a thickness of 0.009 inch which favorably compares to the thickness of a conventional color photographic print.

Figure 2:
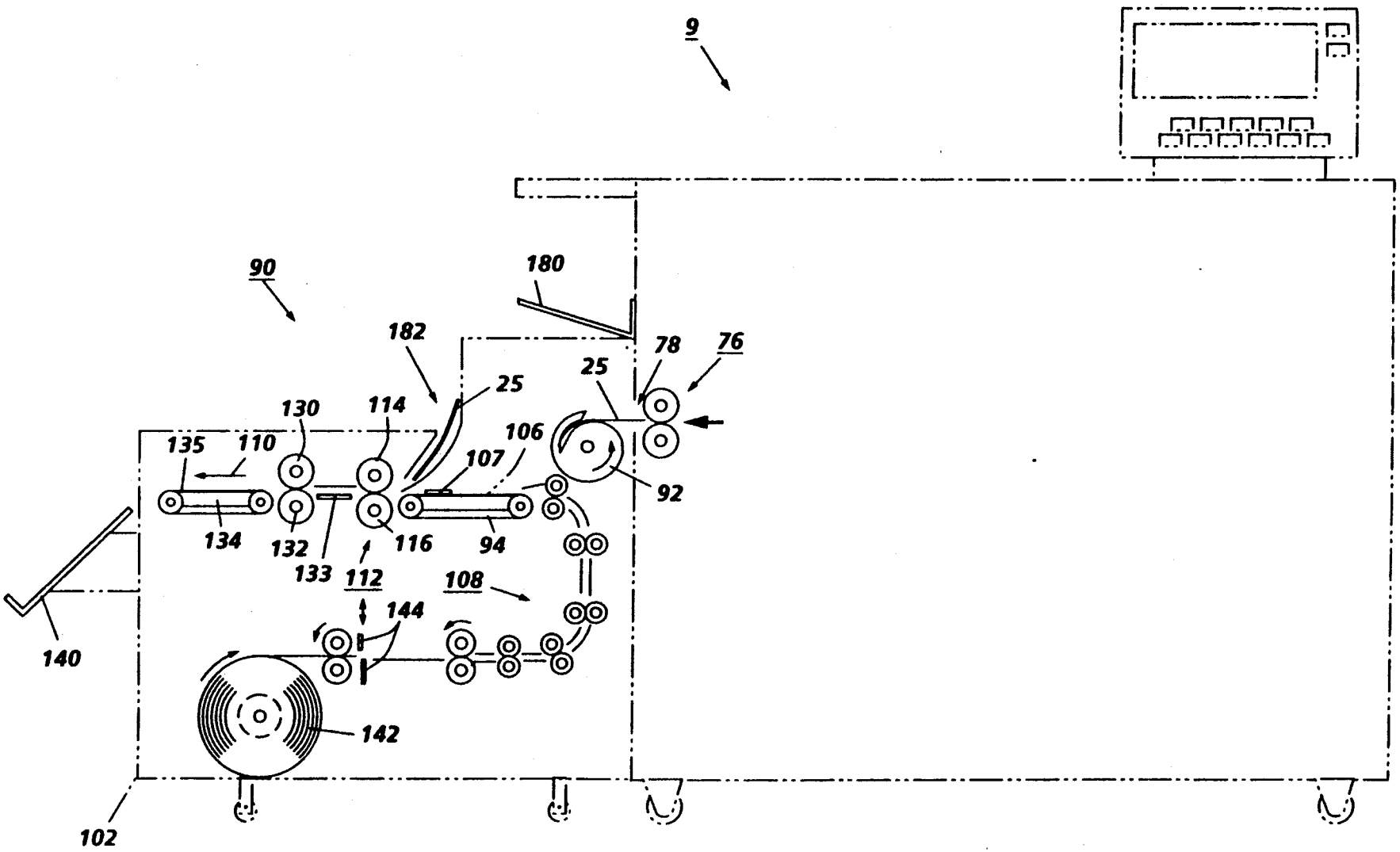
FIG. 2 is a modified embodiment of the imaging apparatus and print processor.

The backing member 106, as shown in FIG. 2, can also be obtained using a roll 142 of backing material which is cut to an appropriate length using a cutter 144. The roll of material may be precoated with a suitable glue for enhancing the adherence of the backing material to the transparent substrate 25.

Figure 4:
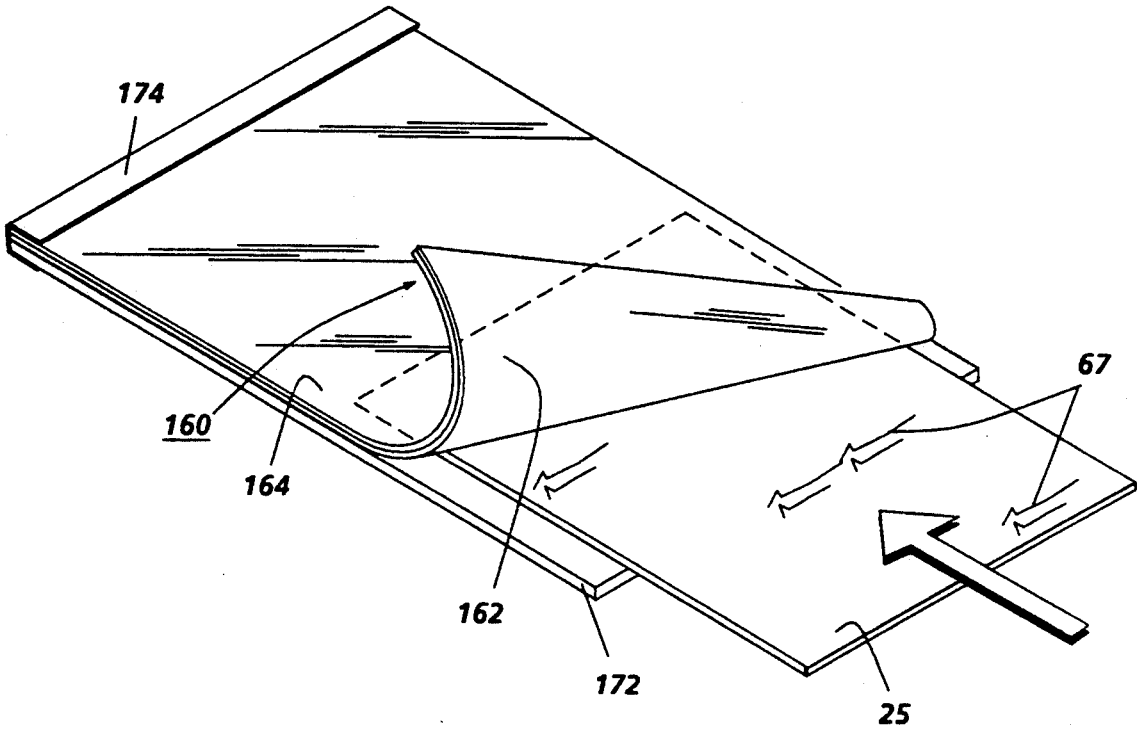
FIG. 4 is a perspective view of a color transfer member.

Alternatively, a light reflective coating can be applied over the toner image by applying a white or near white film to the toner forming the xerographic images on the transparent substrate. As illustrated in FIG. 4, a transfer sheet for applying the white film includes a vacuum deposited film 162 disposed upon a clear or colored polymer film 164, such as, for example, an acrylic film like methyl methacrylate or a methacrylate or a methacrylate copolymer, which is in turn disposed upon a polyester carrier, not shown. An adhesive layer, also not shown, preferably covers the film 162 on the opposite side from the clear polymer film 164. The film 162, adhesive layer, polymer film 164 and a polyester carrier together form the transfer sheet 160 that is adhered at an upper edge to a backing sheet 172. As shown in FIG. 4, the transfer sheet 160 may be attached to the backing sheet 172 by a piece of pressure sensitive tape 174. When the transfer sheet 160 is provided with a backing sheet 172 as seen in FIG. 4, the substrate 25 is positioned between the transfer sheet 160 and the backing sheet 172. The process of coating a toner image with a reflective coating is more fully described in U.S. Pat. No. 4,868,049 granted to Marshall A. Nelson on Sep. 19, 1989.

In use, the transfer sheet 160 is placed in face-to-face contact with the receiving substrate 25 to form a sandwich with the zerographic images contacting the transfer sheet. For this purpose an imaged transparent substrate 25 is directed to an output tray 180 and manually retrieved therefrom. Heat and pressure are used to cause the xerographic images to become tacky and cause the film to adhere to the images. The transfer sheet 160 is then stripped away from the transparent substrate containing the xerographic images 67 overlaid with the light reflective metal film 162.

Various means can be used to apply pressure and temperature in accordance with the present invention, for example, a pair of heat and pressure rolls forming a nip through which the sandwich is passed may be used.

The transparent substrate 25 with the toner image and the reflective coating adhered thereto is bonded to a sheet 106 in the manner similar to that described above in order to create a simulated photographic print in accordance with the invention. To this end a bypass chute 182 is provided as part of the auxiliary processor 90. A transparent substrate 25 containing a toner image coated with a white or near white film is inserted into the chute 182 until its leading edge is disposed in the nip between the rolls 114 and 116. Upon initiation of a print making cycle through use of the UI 14, a reflective backing sheet 106 is fed into the aforementioned nip such that its lead edge coincides with the lead edge of the transparent substrate. The two members are then fed through the heat and pressure rolls 114 and 116 and the rest of the print making elements.

What is claimed is:

1. A method of creating simulated photographic prints using xerographic imaging, including the steps of:

forming a right reading latent electrostatic image on a charge retentive surface;

using suitable toner material, creating a right reading visible image on said charge retentive surface;

transferring said right reading visible image to a transparent substrate thereby creating a mirror image of said right reading image on one surface thereof;

adhering said mirror image to said transparent substrate such that an interface therebetween exhibits good optical properties; and forming a light reflecting backing layer over said mirror image by applying a light color film over said mirror image.

2. The method according to claim 1 including an additional step of adhering a backing sheet over said light color film.

3. The method according to claim 2 wherein the step of adhering a backing sheet comprises adhering a backing sheet having a thickness of approximately 0.004 inch to a transparent substrate having a thickness of approximately 0.004 inch whereby said prints have a thickness approximately equal to a conventional photograph.

4. The method according to claim 3 wherein said step of adhering a backing sheet comprises passing said transparent substrate and said backing sheet through a nip of a heat and pressure roll pair in superimposed relation.

5. The method according to claim 4 including the step of applying an adhesive to said backing sheet prior to passing it through said nip.

6. The method according to claim 5 wherein a pair of rolls of said heat and pressure roll pair are operated at a surface temperature of approximately 160° C.

7. The method according to claim 6 wherein said rolls are provided with an outer layer of silicone rubber.

8. A method of creating simulated photographic prints using xerographic imaging, including the steps of:

forming a light reflecting light color film over one or more xerographically formed mirror images fused to a transparent substrate.

9. The method according to claim 8 including an additional step of adhering a backing sheet to said mirror images, said light color film and said transparent substrate.

10. The method according to claim 9 wherein said step of adhering a backing sheet comprises passing said transparent substrate and said backing sheet through a nip of a heat and pressure roll pair in superimposed relation.

11. The method according to claim 10 wherein a pair of rolls of said heat and pressure roll pair are operated at a surface temperature of approximately 160° C.

12. The method according to claim 9 including the step of applying an adhesive to said backing sheet prior to passing it through said nip.

13. The method according to claim 12 wherein rolls of said heat and pressure roll pair are provided with an outer layer of silicone rubber.

14. The method according to claim 9 wherein the step of adhering a backing sheet comprises adhering a backing sheet having a thickness of approximately 0.004 inch to a transparent substrate having a thickness of approximately 0.004 inch whereby said prints have a thickness approximately equal to a conventional photograph.

15. The method according to claim 14 wherein said step of adhering a backing sheet comprises passing said transparent substrate and said backing sheet through a nip of a heat and pressure roll pair in superimposed relation.

16. The method according to claim 15 including the step of applying an adhesive to said backing sheet prior to passing it through said nip.

17. The method according to claim 16 wherein the rolls of said heat and pressure roll pair are operated at a surface temperature of approximately 160° C.

18. The method according to claim 17 wherein said rolls are provided with an outer layer of silicone rubber.

* * * * *